United States Patent [19]

Hediger et al.

[11] Patent Number: 4,924,272

[45] Date of Patent: May 8, 1990

[54] CLEANING ASSEMBLY FOR ELECTROSTATOGRAPHIC APPARATUS

[75] Inventors: Edwin A. Hediger, Fairport; Brandon H. Brown, Rochester, both of N.Y.

[73] Assignee: Eastman Kodak Company, Rochester, N.Y.

[21] Appl. No.: 278,382

[22] Filed: Dec. 1, 1988

[51] Int. Cl.[5] ..... G03G 21/00

[52] U.S. Cl. ..... 355/298; 15/256.51; 118/652; 355/212; 355/260

[58] Field of Search ..... 355/298, 297, 296, 299, 355/212, 260; 118/652; 15/256.51

[56] References Cited

U.S. PATENT DOCUMENTS

| | | | |
|---|---|---|---|
| 4,174,171 | 11/1979 | Hamaker | 355/212 |
| 4,768,062 | 8/1988 | Tanzawa | 355/298 |
| 4,791,454 | 12/1988 | Takahashi | 355/260 X |
| 4,804,993 | 2/1989 | Kenin | 355/212 |

FOREIGN PATENT DOCUMENTS

| | | | |
|---|---|---|---|
| 0250677 | 10/1988 | Japan | 355/299 |

*Primary Examiner*—A. T. Grimley
*Assistant Examiner*—Thu Dang
*Attorney, Agent, or Firm*—Lawrence P. Kessler

[57] ABSTRACT

In an electrostatographic reproduction apparatus utilizing a dielectric member web supported by guide rollers for movement along a travel path in relation to electrostatographic process stations, including a web cleaning station, a web cleaning assembly is mounted so that it operates effectively to remove residual marking particles from the web without adversely effecting web tracking as it moves along its desired travel path. In a preferred embodiment of this invention, the cleaning assembly comprises a housing including a chamber adapted to store removed residual marking particles, and a member engaging the web to break the bonds between the residual marking particles and the web for sweeping such particles from the web into the chamber. The housing is mounted relative to one of the guide rollers for movement therewith as such guide roller guides the web along the desired travel path, and with the sweeping member in operative association with the web.

7 Claims, 3 Drawing Sheets

CLEANING ASSEMBLY FOR ELECTROSTATOGRAPHIC APPARATUS

BACKGROUND OF THE INVENTION

This invention is directed in general to electrostatographic reproduction apparatus utilizing a dielectric web supported by guide rollers for movement along a travel path in relation to electrostatographic process stations, and more particularly to an assembly for cleaning the dielectric web of such electrostatographic reproduction apparatus.

In electrostatographic reproduction apparatus, it is general practice to provide a dielectric member movable along a path relative to electrostatographic process stations. For example, the dielectric member may be a web supported and guided for movement along the path by rollers. In such process stations, a uniform electrostatic charge is applied to the dielectric member web and such charge is modified in an area of the web to form, in such area, a charge pattern corresponding in imagewise fashion to information to be reproduced. The charge pattern is then developed by applying pigmented marking particles to the web. The particles, which are charged to a polarity opposite to that of the charge pattern on the dielectric member web, adhere to the pattern to form a developed image on the web. The developed image is then transferred to a final receiver member and fixed thereto by heat and/or pressure for example. After image transfer, the dielectric member web is cleaned to remove any residual marking particles prior to reuse of that area of the web.

Cleaning of the dielectric member web of such electrostatographic reproduction apparatus is accomplished by providing an assembly including a member which breaks the mechanical and electrostatic bond between the web and residual marking particles and sweeps the particles from the web. Typically, the cleaning assembly member is, for example, a rotating fur brush (such as shown in U.S. Pat. No. 4,213,794, issued July 22, 1980, in the name of Woodling et al), a rotating magnetic brush (such as shown in U.S. Pat. No. 4,501,484, issued Feb. 26, 1985, in the name of Shimura), or a resilient blade (such as shown in U.S. Pat. No. 4,690,544, issued Sept. 1, 1987, in the name of Fobes, II et al). While fur brush and magnetic brush cleaning members are very effective in providing for residual marking particle removal, there are of complicated construction, and are expensive to employ in the reproduction apparatus. Although less efficient in residual marking particle removal, the resilient sweeper blade is, on the other hand, of simple relatively inexpensive construction.

Accordingly, in electrostatographic reproduction apparatus designed for low volume usage, the resilient blade has been the cleaning assembly member of choice. This is because its simplicity of construction and minimum component cost is of prime importance. Moreover, at lower volume usages, the cleaning efficiency of resilient blades is sufficient to yield acceptable quality reproductions. The resilient blade cleaning assembly member, however, does present a unique potential problem due to its necessary pressure engagement with the dielectric member web to provide minimally acceptable cleaning efficiency. That is, it has a tendency to provide an undue constraint on the web moves in contact with the blade. This results in a potential adverse effect on proper tracking of the web as the web travels about its path relative to the electrostatographic process stations.

SUMMARY OF THE INVENTION

This invention relates to electrostatographic reproduction apparatus utilizing a dielectric member web supported by guide rollers for movement along a travel path in relation to electrostatographic process stations, including a web cleaning station. The web cleaning assembly is mounted so that it operates effectively to remove residual marking particles from the web without adversely effecting web tracking as it moves along its desired travel path. In a preferred embodiment of this invention, the cleaning assembly comprises a housing including a chamber adapted to store removed residual marking particles, and a member engaging the web to break the bonds between the residual marking particles and the web for sweeping such particles from the web into the chamber. The housing is mounted relative to one of the guide rollers for movement therewith as such guide roller guides the web along the desired travel path, and with the sweeping member in operative association with the web.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENTS

Figure 1:
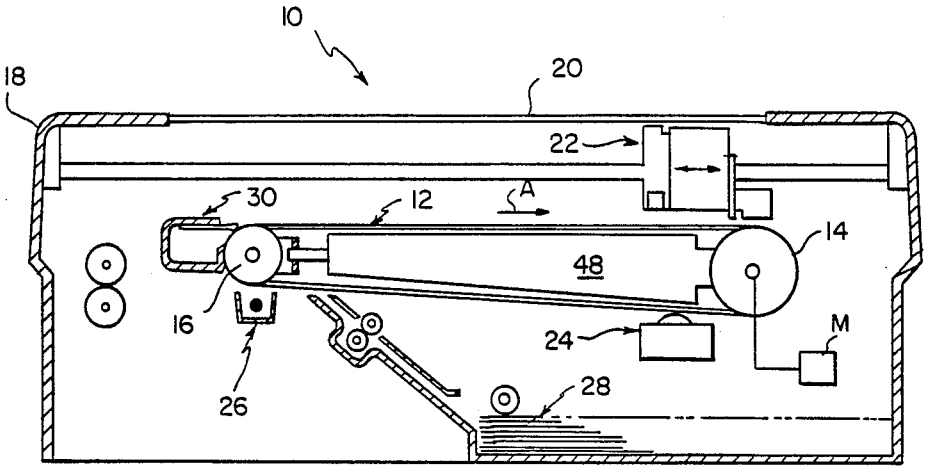
FIG. 1 is a generally schematic side elevational view, in cross-section, of an exemplary electrostatographic reproduction apparatus utilizing a cleaning assembly according to this invention.
Figure 2:
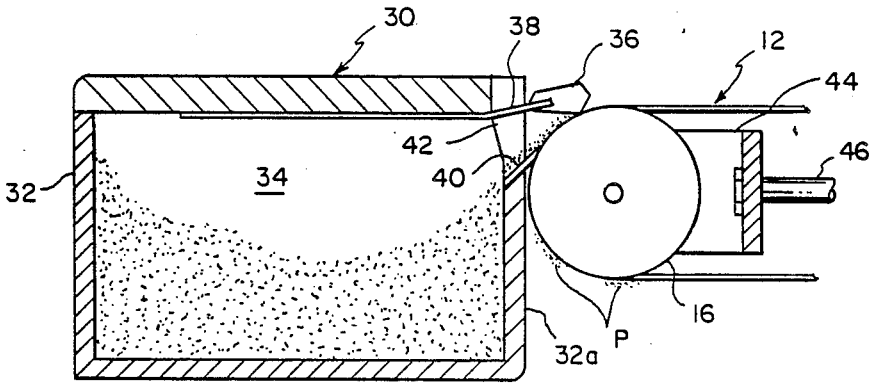
FIG. 2 is a side elevational view, in cross-section and on an enlarged scale, of the cleaning assembly according to this invention.

Referring now to the accompanying drawings, an exemplary electrostatographic reproduction apparatus, designated by the numeral 10, is schematically shown in FIG. 1. The reproduction apparatus 10 utilizes a continuous dielectric member web 12 entrained about guide rollers 14, 16 supported within a housing 18 for rotation in a tracking assembly 48, such as shown in copending U.S. filed in the name of Hediger. Guide roller 14 is selectively driven by a motor M so as to move the web 12 in the direction of arrow A while the tracking assembly 48 assures movement of the web along a travel path in operative relation with conventional electrostatographic process stations.

In this exemplary reproduction apparatus 10, the dielectic web 12 contains a photoconductive layer. Accordingly, exposure of the web to a reflected light image of document to be copied alters a uniform charge placed on the web. Such exposure is accomplished by placing a document on a transparent platen 20 in juxtaposition with a run of the web, and moving a charging and exposure assembly 22 between the web and the transparent platen. The assembly 22 includes a charger for applying a uniform charge to the web 12, a lamp for reflecting light from the document on the platen, and a lens for focusing the reflected light image of the document on the web. The altered charge pattern corresponds in image-wise fashion to the document to be copied. Such charge pattern is developed by applying pigmented marking particles to the web at a magnetic brush development station 24 for example. The particles, which are charged to a polarity opposite to that of the charge pattern on the web 12, adhere to the pattern to form a developed image on the web. A transfer device, such as a charger 26 for example, transfers the developed image to a final receiver member fed in proper registered relation to the web from a receiver supply 28. Thereafter, the transferred image is fixed to the receiver member by heat and/or pressure for example. After image transfer, the dielectric member web 12 is cleaned by a cleaning assembly 30 to remove any residual marking particles prior to reuse of that area of the web. Of course other electrostatographic reproduction apparatus utilizing a dielectric member web supported by guide rollers for movement about a travel path in operative relation to electrostatographic stations is suitable for use with this invention.

The cleaning assembly 30 includes a housing 32 defining a chamber 34, and an opening 42 defined in a side wall 32*a* of the housing communicating with the chamber. A first blade 36, formed of a substantially resilient material such as urethane for example, is attached to the housing 32 by a flexible member 38; and a second blade 40, formed of a substantially resilient material such as polyethyleneterapathalate for example, is attached directly to the housing. The blades 36 and 40 are located on opposite sides of the opening 42. The housing 32 is positioned, according to this invention in the manner described hereinbelow, so that the first blade 36 is urged into line contact, under pressure, with the web 12 near the top dead center of the guide roller 16, and the second blade 40 is in light pressure engagement with the web below the line contact between the web and the first blade. In this manner residual marking particles P pass beneath the second blade 40 and are thereafter swept from the web 12 by the first blade 36. These particles fall, under the influence of gravitational forces, and are trapped by the second blade and directed through the opening 42 into the chamber 34 for collection. The web is thus cleaned of the residual marking particles and readied for reuse so that subsequent developed images formed thereon are substantially free of residual marking particle induced artifacts.

Figure 3:
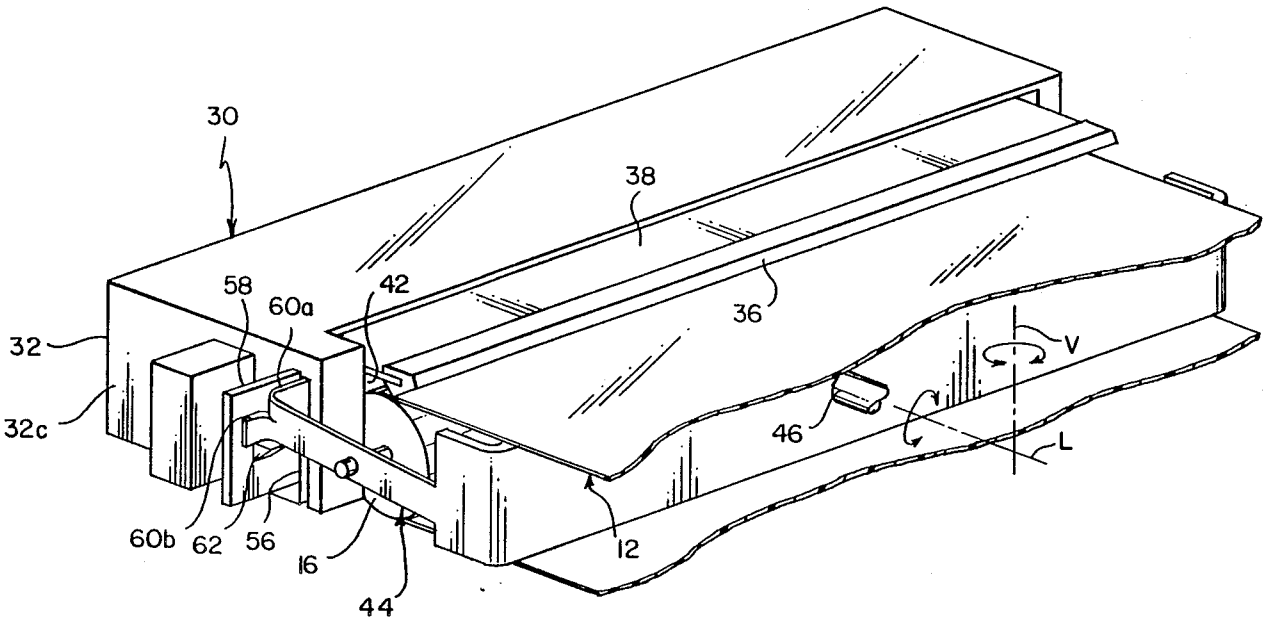
FIG. 3 is a view, in perspective, of the cleaning assembly of FIG. 2 particularly showing the mounting of the thereof with a guide roller for the dielectric member web of the electrostatographic reproduction apparatus of FIG. 1.
Figure 4:
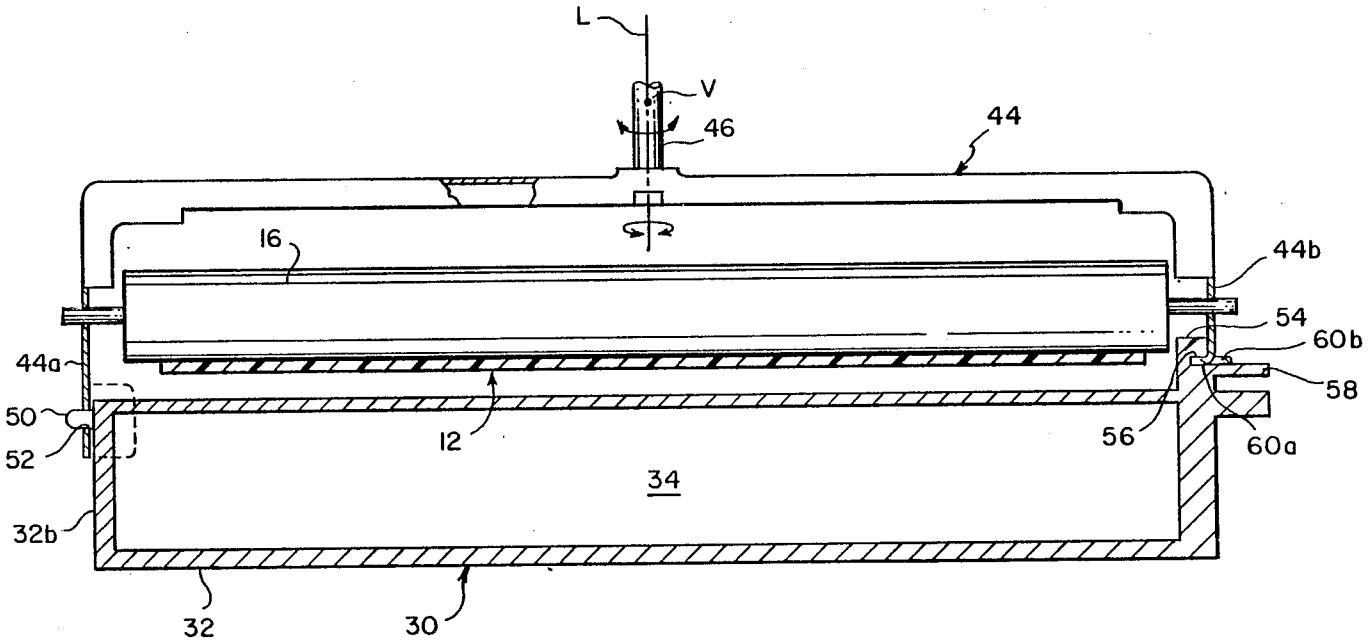
FIG. 4 is a top plan view, in cross-section of the cleaning assembly according to this invention.

The positioning of the cleaning assembly 30 according to this invention is accomplished by a bracket 44 (see FIGS. 3 and 4) which serves as both the mounting for the guide roller 16 and the support for the cleaning assembly 30. The bracket 44 is a substantially U-shaped member supported on a shaft 46 for rotation about the longitudinal axis L of the shaft. The shaft 46 forms a part of the support and tracking assembly 48 (see FIG. 1) for the web 12. As fully described in aforementioned U.S. patent application Ser. No., the shaft 46 is capable of limited rotation about a substantially vertical axis V perpendicular to its longitudinal axis in order to cause the web to track along the desired travel path in proper operative relation with the electrostatographic stations. Accordingly, during the tracking action, the guide roller 16 mounted in the bracket 44 may move with the bracket about the axis V and the axis L.

End 32*b* of the cleaning assembly housing 32 has a pin 50 extending outwardly therefrom at a predefined location. The pin 50 is receivable in an opening 52 defined at a preselected location in arm 44*a* of the bracket 44. The opposite end 32*c* of the housing 32 has a projection 54 which has a groove 56 defined therein at a particular location, and a guide wall 58 extending outwardly therefrom at a predefined location. A stop member 62 extends outwardly from the wall 58. Arm 44*b* of the bracket 44 has tabs 60*a* and 60*b* formed at the outermost end thereof at predefined locations. The tabs 60*a* and 60*b* are respectively oriented at opposite right angles to the arm 44*b*. When the arm 44*b* engages stop 62, tab 60*a* is adapted to be received in the groove 56, and tab 60*b* is adapted to seat on the guide wall 58.

Due to the specific locations of the described elements, the receipt of the pin 50 in the opening 52 and the tabs 60*a* and 60*b* respectively in the groove 56 and against the guide wall 58, accurately locates the cleaning assembly 30 with respect to the bracket 44 and holds the cleaning assembly in positive engagement therewith no matter where the bracket moves. Therefore, the relative relation between the cleaning assembly 30 and the guide roller 16 is held substantially constant. Accordingly, the cleaning assembly can efficiently perform its intended cleaning function of removing residual marking particles from the web; and at the same time, the blades of the cleaning assembly are prevented from imparting undue forces on the web which would potentially cause the web to mistrack as it moves relative to the cleaning station.

The invention has been described in detail with particular reference to a preferred embodiment thereof, but it will be understood that variations and modifications can be effected within the spirit and scope of the invention.

I claim:

1. In a electrostatographic reproduction apparatus including a dielectric web upon which marking particle developed images are formed for transfer to a receiver sheet, said web being supported for movement along a desired path relative to electrostatographic process stations by guide rollers, means for removing residual marking particles from said web, said removing means comprising:

a housing including a chamber adapted to store removed residual marking particles, and means for sweeping residual marking particles from said web into said chamber; and a bracket having a pair of arms, said arms supporting one of said guide rollers, and means associated with said arms for retaining said housing with said sweeping means in operative association with said web.

2. The invention of claim 1 wherein said sweeping means includes a resilient blade.

3. The invention of claim 1 wherein said housing is retained by said retaining means on the opposite side of said web from said one guide roller.

4. The invention of claim 3 wherein said housing includes a pin extending from one end thereof and a groove defined in the opposite end thereof, and wherein said retaining means includes an opening defined in one arm of said bracket adapted to receive said pin, and a tab formed on the opposite arm of said bracket adapted to be received in said groove.

5. The invention of claim 4 wherein said housing further includes a guide wall extending from said opposite end of said housing, and wherein said opposite arm of said bracket includes a tab adapted to engage said guide wall.

6. In an electrostatographic reproduction apparatus including a dielectric web upon which marking particle developed images are formed for transfer to a receiver sheet, said web being supported for movement along a desired path relative to electrostatographic process stations by guide rollers, and a cleaning assembly for removing residual marking particles from said web, means for supporting said cleaning assembly, said supporting means comprising:

a member supporting one of said guide rollers, and means associated with said member for mounting said cleaning assembly in operative association with said web and in relation to said one guide roller for movement therewith as said one guide roller guides said web, said mounting means including a bracket having a pair of arms, said arms supporting said one guide roller, and means associated with said arms for retaining said cleaning assembly with said bracket.

7. The invention of claim 6 wherein said mounting means includes means for coupling said cleaning assembly to said one guide roller in spaced relation thereto with said cleaning assembly being on the opposite side of said web from said one guide roller.

* * * * *